US011655973B2

(12) United States Patent
Lin

(10) Patent No.: US 11,655,973 B2
(45) Date of Patent: May 23, 2023

(54) ILLUMINATION APPARATUS

(71) Applicant: Aputure Imaging Industries Co., Ltd., Shenzhen (CN)

(72) Inventor: Yongquan Lin, Shenzhen (CN)

(73) Assignee: APUTURE IMAGING INDUSTRIES CO., LTD., Shenzhen (CN)

( * ) Notice: Subject to any disclaimer, the term of this patent is extended or adjusted under 35 U.S.C. 154(b) by 0 days.

(21) Appl. No.: 17/539,750

(22) Filed: Dec. 1, 2021

(65) Prior Publication Data

US 2023/0003371 A1 Jan. 5, 2023
US 2023/0003371 A1 Jan. 5, 2023

(30) Foreign Application Priority Data

Jun. 30, 2021 (CN) ..... 202121489313.X

(51) Int. Cl.
*F21V 29/67* (2015.01)
*F21V 29/51* (2015.01)
*F21V 29/74* (2015.01)

(52) U.S. Cl.
CPC ..... *F21V 29/67* (2015.01); *F21V 29/51* (2015.01); *F21V 29/74* (2015.01)

(58) Field of Classification Search
CPC ..... F21V 29/51; F21V 29/83; F21V 29/74; F21V 29/67; F21V 29/763; F21V 29/677; F21V 29/75; F21V 29/76; F21V 29/773
See application file for complete search history.

(56) References Cited

U.S. PATENT DOCUMENTS 7,674,012 B1 * 3/2010 Lin ..... F21V 29/83 362/240
8,294,340 B2 * 10/2012 Yu ..... F21K 9/00 362/241
8,858,026 B2 * 10/2014 Lee ..... F28D 15/0233 362/249.02
2009/0034275 A1 * 2/2009 Cheng ..... F21K 9/00 362/373
2009/0129092 A1 * 5/2009 Chen ..... F21V 29/74 362/294
2010/0128482 A1 * 5/2010 Zhou ..... F21V 29/763 362/373
2010/0149799 A1 * 6/2010 Liu ..... F21V 29/67 362/249.02
2011/0038153 A1 * 2/2011 Hu ..... F21V 29/83 362/249.02

(Continued)

*Primary Examiner* — William J Carter
(74) *Attorney, Agent, or Firm* — Alston & Bird LLP

(57) ABSTRACT

An illumination apparatus, including: a light source assembly, a circuit board, a fin assembly, and a fan. The fin assembly includes a plurality of fins arranged at intervals. The plurality of fins each has a first thermal connection end and a second thermal connection end arranged oppositely to each other, as well as a first thermal dissipation end and a second thermal dissipation end arranged oppositely to each other. The light source assembly is in thermal connection with the first thermal connection end, and the circuit board is in thermal connection with the second thermal connection end. The airflow generated by the fan is enabled to pass through the fins and flow out from the first thermal dissipation end and the second thermal dissipation end to drive a heat of the first thermal connection end and the second thermal connection end out of the fin assembly.

19 Claims, 6 Drawing Sheets

(56) References Cited

U.S. PATENT DOCUMENTS

| | | | | |
|---|---|---|---|---|
| 2012/0262922 | A1* | 10/2012 | Yang | F21V 29/76 362/268 |
| 2014/0268798 | A1* | 9/2014 | Lin | F21V 29/505 362/294 |
| 2016/0053983 | A1* | 2/2016 | Wang | F21V 29/71 362/373 |
| 2016/0057944 | A1* | 3/2016 | Smits | A01G 9/249 362/373 |

* cited by examiner

ILLUMINATION APPARATUS

CROSS-REFERENCE TO RELATED APPLICATIONS

Pursuant to 35 U.S.C. § 119 and the Paris Convention, this application claims priority to and the benefit of Chinese Patent Application No. 202121489313.X filed Jun. 30, 2021, the contents of which as are incorporated herein by reference in their entirety.

TECHNICAL FIELD

The present application relates to the technical field of illumination, and more particularly to an illumination apparatus.

BACKGROUND

Illumination apparatuses are often needed to illuminate scenes or subjects in film and television dramas, videos, advertisements, stages, live broadcasts, and other shooting scenes. For example, illumination apparatus can illuminate the subjects to reduce the generation of dark shadows, as well as simulate natural light effects in natural conditions (such as day, noon, night, etc.), or simulate special scenes (such as lightning, fireworks, etc.). When a large-area shooting scene is involved, more illumination apparatuses are generally utilized for the purpose of producing light with stronger brightness. However, the utilization of the multiple apparatuses results in occupy of a large space, troublesome operation, and failure to achieve a desired effect, thus high-power illumination apparatuses are desired. High-power illumination apparatuses involve more light sources, such as LED light-emitting units, which means that high-power driving power circuits and complex control circuits are also required. Technicians of the present application found that the heat dissipation performance of the existing high-power LED light source apparatus is poor, which is not conducive to the stable operation of related components.

SUMMARY

It is an object of the embodiments of the present application to provide an illumination apparatus, to solve the technical problem of poor heat dissipation effect of the existing high-powered apparatus.

To achieve the above object, the present application adopt the following technical solutions:

An illumination apparatus is provided. The illumination apparatus comprises: a light source assembly, a circuit board, a fin assembly, and a fan. The light source assembly is in electrical connection with the circuit board. The fan is configured to generate a flowing airflow. The fin assembly comprises a plurality of fins arranged at intervals in a configured direction. The plurality of fins each has a first thermal connection end and a second thermal connection end arranged oppositely to each other, as well as a first thermal dissipation end and a second thermal dissipation end arranged oppositely to each other. A connection line connecting the first thermal connection end and the second thermal connection end is defined as a first connection line. A connection line connecting the first thermal dissipation end and the second thermal dissipation end is defined as a second connection line. The first connection line and the second connection line forms an angle. The light source assembly is in thermal connection with the first thermal connection end, and the circuit board is in thermal connection with the second thermal connection end. The airflow generated by the fan is enabled to pass through the fins and flow out from the first thermal dissipation end and the second thermal dissipation end to drive a heat of the first thermal connection end and the second thermal connection end out of the fin assembly.

In an embodiment, the illumination apparatus further comprises a first substrate; and a side of the first substrate facing the light source assembly is in thermal connection with the light source assembly, and a side of the first substrate away from the light source assembly is in thermal connection with the first thermal connection end; and/or, the illumination apparatus further comprises a second substrate; and a side of the second substrate facing the circuit board is in thermal connection with the circuit board, and a side of the second substrate far away from the circuit board is in thermal connection with the second thermal connection end.

In an embodiment, the circuit board has at least two electrical assemblies having different powers. The at least two electrical assemblies are sequentially arranged along a direction of the second connection line. The illumination apparatus further comprises a plurality of heat tubes. The plurality of heat tubes are in thermal connection between the first thermal connection end and the first substrate. The plurality of heat tubes are arranged at intervals along a direction of the second connection line. The arrangement density of the plurality of heat tubes is positively related to a power of the electrical module assembly.

In an embodiment, the illumination apparatus further comprises a casing. The casing defines therein first air inlets and air outlets passing through a casing wall. The first air inlets are arranged perpendicular to a plane formed by the first connection line and the second connection line. The first air inlets communicate with gaps among blades of the fan. The air outlets communicate with the first thermal dissipation ends and the second thermal dissipation ends. The connection path between the first air inlets and the gaps among the blades linearly extends along the direction of the first connection line. Both the connection path between the air outlets and the first thermal dissipation ends and the connection path between the air outlets and the second thermal dissipation ends extend along the direction of the second connecting line.

In an embodiment, the illumination apparatus further comprises a power source. The power source is connected within the casing. The power source is in electrical connection with one or more of the light source assembly, the circuit board, and the fan. The power source is arranged in the connection path between the first air inlets and the gaps among the blades; or alternatively, the power source is arranged in the connection path between the air outlets and the first thermal dissipation ends or the connection path between the air outlets and the second thermal dissipation ends.

In an embodiment, the casing further defines therein second air inlets passing through the casing wall. The second air inlets are arranged adjacent to the first air inlets. The second air inlets are arranged perpendicular to the plane formed by the first connection line and the second connection line. The second air inlets and the circuit board are arranged oppositely to each other in the direction of the first connection line and a negative pressure zone is formed between the second air inlets and the circuit board. The fan is configured to draw air through the first air inlets and evacuate the airflow in the negative pressure zone, so that a negative pressure is formed in the negative pressure zone and the airflow outside the casing is drawn through the second air inlets.

In an embodiment, the fin assembly defines therein a first accommodation cavity. The first accommodation cavity is concaved in the direction of the first connection line. The first accommodation cavity is arranged between the first thermal dissipation ends and the second thermal dissipation ends. The fan is located in the first accommodation cavity. The fan and the fin assembly at least partially overlap with each along the direction of the first connection line.

In an embodiment, The illumination apparatus further comprises a first substrate and a second substrate.

A side of the first substrate facing the light source assembly is in thermal connection with the light source assembly, and a side of the first substrate away from the light source assembly is in thermal connection with the first thermal connection end.

A side of the second substrate facing the circuit board is in thermal connection with the circuit board, and a side of the second substrate far away from the circuit board is in thermal connection with the second thermal connection end.

First notches are defined at edges of the first substrate, second notches are defined at edges of the second substrate, third notches are defined at the first thermal dissipation ends and/or the second thermal dissipation ends, and the first notches, the second notches, and the third notches communicate along the direction of the first connection line.

The illumination apparatus further comprises an electrical connector. The circuit board and the light source assembly are electrically connected through the electrical connector. The electrical connector is arranged within the space communicating the first notches, the second notches, and the third notches.

In an embodiment, the light source assembly comprises a plurality of light plate. The plurality of the light plates are in thermal connection with the first substrate. The plurality of the light plates are arranged along the arrangement direction of the fins.

In an embodiment, the fan is one of a plurality of fans. The plurality of fans are arranged along the arrangement direction of the light plates, and each of the fans corresponds to one of the light plates in the direction of the first connection line. The airflow generated by the fans is enabled to drive a heat of the second thermal connection end from the second thermal connection end to the first thermal connection end, and to drive both a heat of the first thermal connection end and the heat of the second thermal connection end to be synchronously discharged out of the fin assembly from the first thermal connection end.

Advantages of the illumination apparatus according to embodiments of the present application are summarized as follows:

In the illumination apparatus provided by the above embodiments, the fin assembly comprises a plurality of fins arranged at intervals along a configured direction, and heat conduction gaps are formed between adjacent fins. The fins each has the first thermal connection end and the second thermal connection end which are oppositely arranged to each other. The light source assembly is in thermal connection with the first thermal connection end, and the heat generated by the light source assembly can be conducted to the first thermal connection end. The circuit board is in thermal connection with the second thermal connection end, and the heat generated by the circuit board can be conducted to the second thermal connection end. In this way, the heat generated by the light source assembly and the heat generated by the circuit board are conducted to the fin assembly through independent paths. The fins each the first thermal dissipation end and the second thermal dissipation end which are oppositely arranged. The connection line connecting the first thermal dissipation end and the second thermal dissipation end is defined as the second connection. The connection line connecting the first thermal connection end and the second thermal connection end is defined as the first connection. The first connection line and the second connection line form an angle. Therefore, the thermal connection ends and the heat dissipation ends of each fin are distributed across, and the airflow generated by the fan can be directed through the fins and flow out from the first thermal dissipation ends and the second thermal dissipation ends, without adversely affecting the thermal connection ends and the heat dissipation ends of the fins of the fins, and the heat of multiple components requiring heat dissipation in the apparatus can be smoothly discharged.

In the illumination apparatus provided by the above embodiments, different ends of the fins in the fin assembly are configured to realize different functions. Different ends of the fins are fully utilized, and corresponding heat conduction paths are particularly configured for the components requiring heat dissipation in the apparatus, such that the components requiring heat dissipation are provided with separate heat conduction paths. Since the components requiring heat dissipation in the apparatus are different in the heating powers as well as the heat quantity required to be dissipated per unit time, each component requiring heat dissipation has an independent heat conduction path. Each path can be correspondingly constructed according to the heating power of the corresponding components requiring heat dissipation. Each path can be fully utilized. The heat dissipation path has no margin, the heat dissipation area has no waste, the structure of the whole apparatus can be simplified, the lightweight can be realized, and the heat dissipation efficiency is synchronously improved.

BRIEF DESCRIPTION OF THE DRAWINGS

In order to illustrate the technical solutions more clearly in the embodiments of the present application, the drawings that need to be used in the description of the embodiments or the prior art will be briefly described hereinbelow. Obviously, the accompanying drawings in the following description are only some embodiments of the present application. For those skilled in the art, other drawings can be obtained based on these drawings without creative work.

Figure 1:
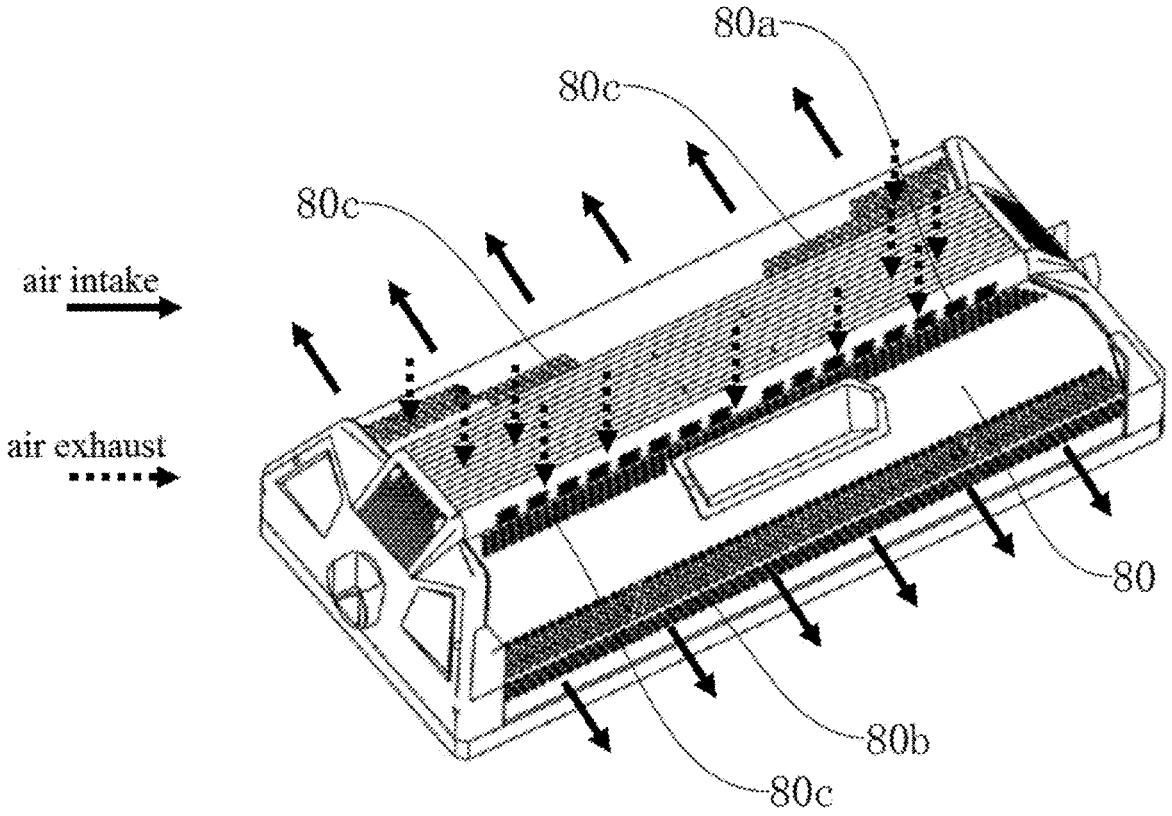
FIG. 1 is a schematic view of an assembled illumination apparatus provided by an embodiment of the present application, where an air intake direction and an air exhaust direction of the apparatus are indicated.

In the drawings, the following reference numerals are adopted:

10: Light source assembly; 11: Light plate; 12: Optical sheet; 20: Circuit board; 30: Fin assembly; 40: Fan; 50: First substrate; 60: Second substrate; 70: Heat tube; 80: Casing; 90: Power source; 20*a*: First electrical module; 20*b*: Second electrical module; 30*a*: First thermal connection end; 30*b*: Second thermal connection end; 30*c*: First thermal dissipation end; 30*d*: Second thermal dissipation end; 30*e*: First accommodation cavity; 30*f*: Third notch; 50*a*: First notch; 60*a*: Second notch; 70*a*: First heat tube group; 70*b*: Second heat tube group; 80*a*: First air inlet; 80*b*: Air outlet; 80*c*: Second air inlet; and 80*d*: Center region of casing.

DETAILED DESCRIPTION OF THE EMBODIMENTS

In order to make the purposes, technical solutions, and advantages of the present application clearer and more understandable, the present application will be further described in detail hereinafter with reference to the accompanying drawings and embodiments. It should be understood that the embodiments described herein are only intended to illustrate but not to limit the present application.

It should be noted that when an element is described as "fixed" or "arranged" on/at another element, it means that the element can be directly or indirectly fixed or arranged on/at another element. When an element is described as "connected" to/with another element, it means that the element can be directly or indirectly connected to/with another element.

It should be understood that terms "length", "width", "upper", "lower", "front", "rear", "left", "right", "vertical", "horizontal", "top", "bottom", "inside", "outside" and the like indicating orientation or positional relationship are based on the orientation or the positional relationship shown in the drawings, and are merely for facilitating and simplifying the description of the present application, rather than indicating or implying that an apparatus or component must have a particular orientation, or be configured or operated in a particular orientation, and thus should not be construed as limiting the application.

It should be understood that terms like "first" and "second" are only used for the purpose of description, and will in no way be interpreted as indication or hint of relative importance or implicitly indicate the number of the referred technical features. Thus, the features prefixed by "first" and "second" will explicitly or implicitly represent that one or more of the referred technical features are comprised. In the description of the present application, "multiple"/"a plurality of" refers to the number of two or more than two, unless otherwise clearly and specifically defined.

An illumination apparatus provided by embodiments of the present application is described hereinbelow.

As shown in FIGS. 1-4, an illumination apparatus provided by embodiments of the present application comprises: a light source assembly 10, a circuit board 20, a fin assembly 30, and a fan 40. The light source assembly 10 is in electrical connection with the circuit board 20. The fan 40 is configured to generate flowing airflow.

The fin assembly 30 comprises a plurality of fins arranged at intervals in a configured direction. The configured direction is a length direction of the illumination apparatus as shown in FIGS. 1-4 (the illumination apparatus provided by this application presents a cuboid as a whole). The plurality of fins each has a first thermal connection end 30*a* and a second thermal connection end 30*b* arranged oppositely to each other, as well as a first thermal dissipation end 30*c* and a second thermal dissipation end 30*d* arranged oppositely to each other. A connection line connecting the first thermal connection end 30*a* and the second thermal connection end 30*b* is defined as a first connection line. A connection line connecting the first thermal dissipation end 30*c* and the second thermal dissipation end 30*d* is defined as a second connection line. The first connection line and the second connection line forms an angle.

The light source assembly 10 is in thermal connection with the first thermal connection end 30*a*, and the circuit board 20 is in thermal connection with the second thermal connection end 30*b*. The airflow generated by the fan 40 is enabled to pass through the fins and flow out from the first thermal dissipation end 30*c* and the second thermal dissipation end 30*d* to drive a heat of the first thermal connection end 30*a* and the second thermal connection end 30*b* out of the fin assembly 30.

In the illumination apparatus provided by the above embodiment, the fin assembly 30 comprises a plurality of fins arranged at intervals along a configured direction, and heat conduction gaps are formed between adjacent fins. The fins each has the first thermal connection end 30*a* and the second thermal connection end 30*b* which are oppositely arranged to each other. The light source assembly 10 is in thermal connection with the first thermal connection end 30*a*, and the heat generated by the light source assembly 10 can be conducted to the first thermal connection end 30*a*. The circuit board 20 is in thermal connection with the second thermal connection end 30*b*, and the heat generated by the circuit board 20 can be conducted to the second thermal connection end 30*b*. In this way, the heat generated by the light source assembly 10 and the heat generated by the circuit board 20 are conducted to the fin assembly 30 through independent paths. The fins each has the first thermal dissipation end 30*c* and the second thermal dissipation end 30*d* which are oppositely arranged. The connection line connecting the first thermal dissipation end 30*c* and the second thermal dissipation end 30*d* is defined as the second connection. The connection line connecting the first thermal connection end 30*a* and the second thermal connection end 30*b* is defined as the first connection. The first connection line and the second connection line form an angle. Therefore, the thermal connection ends and the heat dissipation ends of each fin are distributed across, and the airflow generated by the fan 40 can be directed through the fins and flow out from the first thermal dissipation ends 30*c* and the second thermal dissipation ends 30*d*, without adversely affecting the thermal connection ends and the heat dissipation ends of the fins of the fins, and the heat of multiple components requiring heat dissipation in the apparatus can be smoothly discharged.

In the illumination apparatus provided by the above embodiment, different ends of the fins in the fin assembly 30 are configured to realize different functions. Different ends of the fins are fully utilized, and corresponding heat conduction paths are particularly configured for the components requiring heat dissipation in the apparatus, such that the components requiring heat dissipation are provided with separate heat conduction paths. Each path can be correspondingly constructed according to the heating power of the corresponding components requiring heat dissipation. Each path can be fully utilized. The heat dissipation path has no margin, the heat dissipation area has no waste, and the heat dissipation efficiency is synchronously improved, such that the series problems caused by the integration of the components requiring heat dissipation in the light source in the existing technology are avoided.

In the embodiment of the present application, as shown in FIGS. 1-4, the plurality of fins of the fin assembly 30 are arranged sequentially at intervals along the length direction of the illumination apparatus (perpendicular to both the direction of the first connection line and the second connection line).

In a width direction (that is, the direction of the second connection line) of the illumination apparatus, each fin extends to a certain distance along a straight line. The first thermal dissipation end 30*c* and the second thermal dissipation end 30*d* are two ends of each fin along a length direction of each fin, respectively.

In a thickness direction of the illumination apparatus (that is, the direction of the first connection line), each fin extends to a certain distance along a straight line. A length of each fin is several folds a thickness of each fin. The first thermal connection end 30*a* and the second thermal connection end 30*b* are another two ends of each fin along a thickness direction of each fin, respectively.

In an embodiment, the direction of the first connection line completely coincides with the thickness direction of each fin, the direction of the second connection line completely coincides with the length direction of each fin, the first connection and the second connection are perpendicular to each other and present an angle of 90°. For example, from the perspective of the illumination apparatus, the direction of the first connection line can be the thickness (side) direction of the illumination apparatus, and the direction of the second connection line can be the width (side) direction of the illumination apparatus, and a plane perpendicular to both the first connection line and the second connection line may extend along the length (side) direction of the illumination apparatus.

In other embodiments, the fin assembly can be modified according to the overall structure requirements of the illumination apparatus. For example, taking a central axis of the fin assembly 30 in the length direction as a folding line, the fin assembly 30 is folded by a certain angle, for example, 15°, and the angle between the first connection line and the second connection line is not a right angle anymore, however, this does not affect the heat dissipation of the first thermal connection end 30*a* and the second thermal connection end 30*b*.

In an embodiment of the present application, the fan 40 is arranged close to the second thermal connection end 30*b* and away from the first thermal connection end 30*a*.

For example, when the overall thickness of the illumination apparatus may not be considered, the fan 40 can be arranged above the first thermal connection end 30*a*, and in such case, the fan 40 is arranged furthest away from the second thermal connection end 30*b*.

For example, when the overall thickness of the illumination apparatus is considered, at least part of the fan 40 and at least part of the fin assembly 30 can be overlapped in the direction of the first connection line. In such case, the fan 40 is relatively close to the second thermal connection end 30*b*. Specifically, based on the consideration of the overall thickness of the illumination apparatus, the configuration of the fan 40 is described in detail in the following embodiments.

The fan 40 is arranged close to the second thermal connection end 30*b* and far away from the first thermal connection end 30*a*. The airflow generated by the fan 40 can drive the heat of the second thermal connection end 30*b* from the second thermal connection end 30*b* to the first thermal connection end 30*a*, and drive both the heat of the first thermal connection end 30*a* and the heat of the second thermal connection end 30*b* to be synchronously discharged out of the fin assembly 30 from the first thermal connection end 30*a*. Combined with the downward pressure blowing configuration of the fan 40 in the following embodiments, the heat of the first thermal connection end 30*a* and the heat of the second thermal connection end 30*b* can be efficiently conducted.

In other embodiments, reverse configurations can be adopted. For example, in conditions permitted by the space and structure, the fan 40 can be arranged close to the first thermal connection end 30*a* and far away from the second thermal connection end 30*b*. The airflow generated by the fan 40 can drive the heat of the first thermal connection end 30*a* from the first thermal connection end 30*a* to the second thermal connection end 30*b*, and drives both the heat of the second thermal connection end 30*b* and the heat of the first thermal connection end 30*a* to be synchronously discharged out of the fin assembly from the second thermal connection end 30*b*. Such configuration is adaptable to the case where the first air inlet 80*a* is arranged close to the first thermal connection end 30*a*, for example, the arrangement of the first air inlet 80*a* and the air outlet 80*b* of the present application are exchanged, and the heat dissipation path is required to be configured reversely.

It can be understood that the fan 40 can be arranged at a position equally spaced apart from both first thermal connection end 30*a* and the second thermal connection end 30*b*. In such case, the fan 40 may adopt flat blades, the airflow is not necessary to be pressed down. The heat can be directly and linearly drawn out of the fin assembly 30 through fin gaps along the direction of the second connection line.

Figure 3:
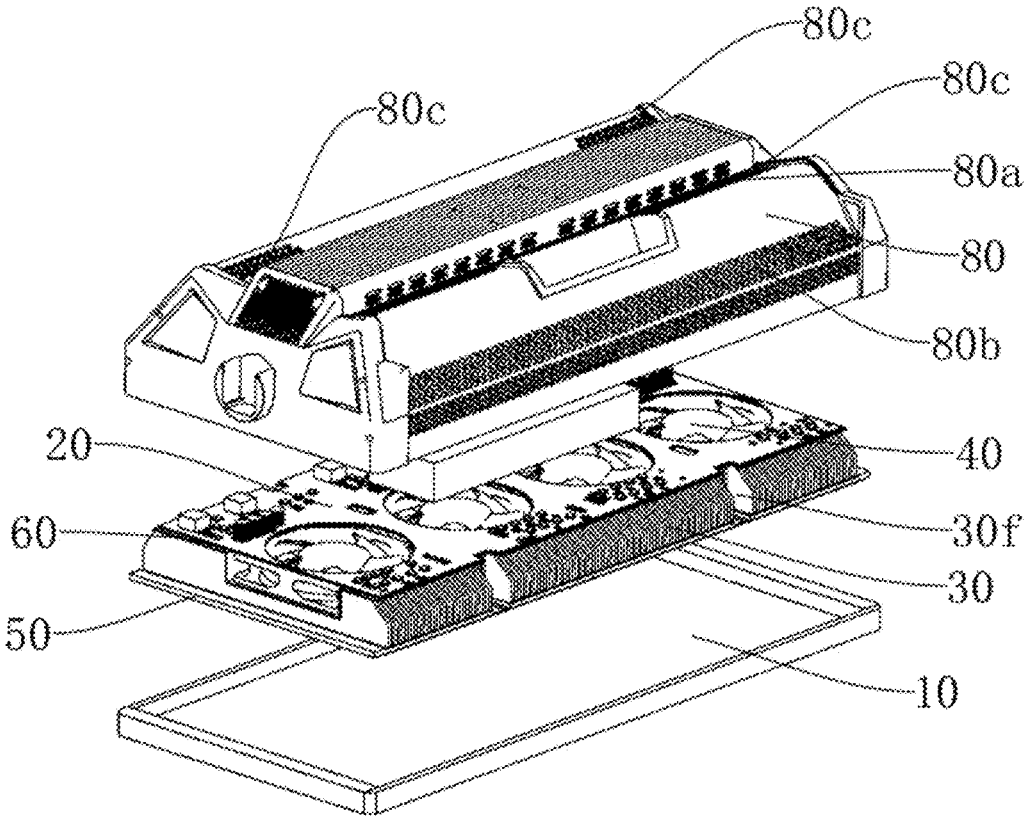
FIG. 3 is an exploded schematic view of an illumination apparatus provided by an embodiment of the present application.
Figure 4:
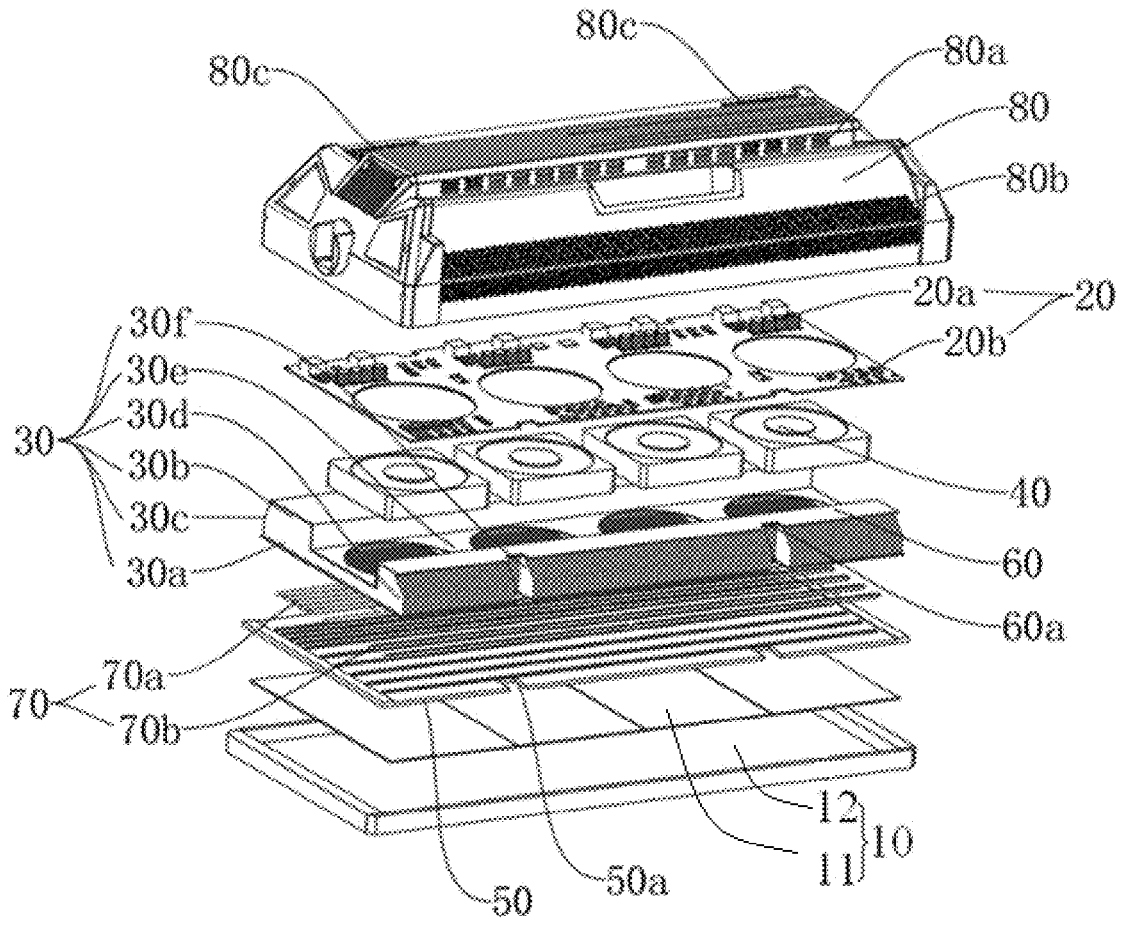
FIG. 4 is another exploded schematic view of an illumination apparatus provided by an embodiment of the present application.
Figure 5:
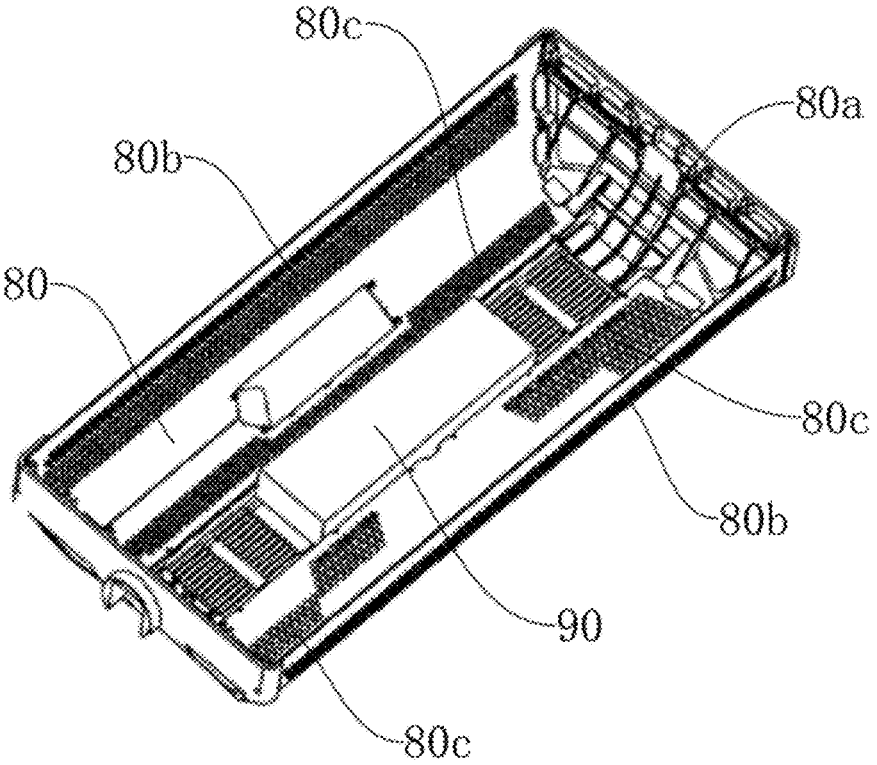
FIG. 5 is a schematic view of an inner side of an illumination apparatus provided by an embodiment of the present application.

As shown in FIGS. 3-4, in an embodiment, the illumination apparatus further comprises a first substrate 50. The first substrate 50 is preferably an aluminum alloy plate. A side of the first substrate 50 away from the light source assembly 10 is in thermal connection with the first thermal connection end 30*a*, a side of the first substrate 50 facing the light source assembly 10 is in thermal connection with the light source assembly 10; and/or, the illumination apparatus further comprises a second substrate 60, the second substrate 60 is preferably an aluminum alloy plate; a side of the second substrate 60 far away from the circuit board 20 is in thermal connection with the second thermal connection end 30*b*, and a side of the second substrate 60 facing the circuit board 20 is in thermal connection with the circuit board 20.

Specifically, along the direction of the first connection line, the circuit board 20 and the light source assembly 10 are arranged relatively in parallel, and the first substrate 50 and the second substrate 60 are arranged relatively in parallel. The first substrate 50 and the second substrate 60 are arranged between the circuit board 20 and the light source assembly 10, and the fin assembly 30 is located between the first substrate 50 and the second substrate 60. A plurality of the first thermal connection ends 30*a* of the plurality of fins in the fin assembly 30 are flush with each other, and a first side of the first substrate 50 is connected to the plurality of the first thermal connection ends 30*a*. A plurality of the second thermal connection ends 30*b* of the plurality of fins in the fin assembly 30 are flush with each other, and a first side of the second substrate 60 is connected to the plurality of the second thermal connection ends 30*b*.

More specifically, the circuit board 20 has at least two electrical assemblies having different powers, each electrical module assembly comprises multiple electrical modules, and each electrical module comprises multiple electrical components. The circuit board 20 may be a printed circuit board, and the electrical components may be components such as inductors, chips, resistors, switch tubes, and capacitors.

In this embodiment, the circuit board 20 has two electrical assemblies having different powers. The two electrical assemblies having different powers are arranged at intervals along the width direction of the illumination apparatus (the direction of the first connection line), and the fan 40 can be arranged within the space between the two electrical assemblies having different powers.

Specifically, a plurality of via holes with larger apertures can be defined in the circuit board 30, so that the fan 40 can be accommodated first accommodation cavities 30*e*, which will described hereinbelow, through the via holes. It can be understood that, the configuration of the via holes also facilitates the airflow flowing between the first air inlets 80*a* and the fan 40 described below.

It can be understood that, in other embodiments, the circuit board 20 may have two or more electrical assemblies having different powers. The two or more electrical assemblies having different powers can be sequentially arranged at intervals along the width direction of the illumination apparatus (that is, the direction of the first connection line), according to an order of power increase or decrease.

A plurality of electrical assemblies having the same power may be provided and arranged along the length direction of the illumination apparatus (that is, the arrangement direction of the fins). In such case, the plurality of electrical assemblies having the same power may be arranged sequentially in a straight line. Such a linear arrangement is consistent with the linear arrangement of a plurality of segmental heat tubes, which enables the plurality of segmental heat tubes to balance the heat of the electrical assemblies having the same power.

The circuit board 20 is provided with through holes passing through the circuit board in the thickness direction. The electrical modules are arranged on the side of the circuit board 20 away from the fin assembly 30, and the electrical modules cover the through holes defined in the circuit board 20. It can be understood that the electrical modules can also be soldered onto the circuit board 20 without passing through the circuit board. The heat of the electrical modules can be conducted to the side of the circuit board 20 facing the fin assembly 30 through the through holes. As the side of the circuit board 20 facing the fin assembly is in thermal connection with the second substrate 60, the heat of the electrical modules is conducted to the second substrate 60 and in turn transferred to the second thermal connection ends 30*b* of the fins.

Due to the downward pressure blowing configurations of the fan 40 in this embodiment, when the heat of the electrical modules reaches the second thermal connection ends 30*b*, the heat is blown by the fan 40 to the first thermal connection ends 30*a*, during which, the heat is transferred to the first thermal dissipation end 30*c* and the second thermal dissipation end 30*d* through adjacent fins, until being discharged out of the fin assembly 30.

Preferably, the second side of the first substrate 50 is integrally coated with a layer of thermally conductive silica gel, and therefore completely attached to the side of the light source assembly 10 facing the first substrate 50 through the thermally conductive silica gel. In this way, not only is the heat conduction efficiency improved, but also the heat conduction resistance is reduced.

In an embodiment, the light source assembly 10 comprises a plurality of light plate 11 and an optical sheet 12. A casing 80 is provided at a backlight side of the light plate 11. The optical sheet 12 may have a soft light or light mixing plastic or a lens. The number of the light plates 11 may be, for example, 2, 3, 4, 5, etc. A plurality of the light plates 11 are in thermal connection with the first substrate 50, for example, the plurality of the light plates 11 can be attached to the first substrate 50 by screws or thermally conductive silica gel, and the plurality of the light plates 11 are arranged along the arrangement direction of the fins. It can be understood that the plurality of the light plates 11 are spliced sequentially, leaving thermal gaps arranged between adjacent light plates 11. It can be understood that in some application scenarios, as the power increases, for example, the LED light plate having larger area is needed. However, a whole piece of LED light plate having an excessively large area is likely to result heat accumulation in the center, which may easily result in local bumps in the light plate due to uneven heat of the light plate. Therefore, the use of the splicing arrangement of the plurality of light plate 11 on the first substrate 50 leaving thermal gaps between adjacent light plates 11, rather than a whole piece of large sized light plate, is prone to dissipate the heat more evenly. Beside, it is not easy to damage the light plate 11.

In some embodiments, the illumination apparatus may comprise a plurality of the fans 40, for example, 2, 3, 4, 5, or more fans, the plurality of the fan 40 are arranged along the arrangement direction of the light plates 11, and each of the fans 40 corresponds to one of the light plates 11 in the direction of the first connection line. It can be understood that each fan 40 is disposed above the corresponding light plate 11, such that the heat of the light plate 11 can be conducted to the fins via the heat tubes, and then discharged out by the fan 40. The above arrangement facilitates excellent heat dissipation of the illumination apparatus having a high power.

As shown in FIG. 3, in an embodiment, the circuit board 20 has at least two electrical assemblies having different powers. The at least two electrical assemblies are sequentially arranged along the direction of the second connection line. The illumination apparatus further comprises a plurality of heat tubes 70. The plurality of heat tubes 70 are in thermal connection between the first thermal connection end 30*a* and the first substrate 50. The plurality of heat tubes 70 are arranged at intervals along the direction of the second connection line. The arrangement density of the plurality of heat tubes 70 is positively related to a power of the electrical module assembly.

Figure 6:
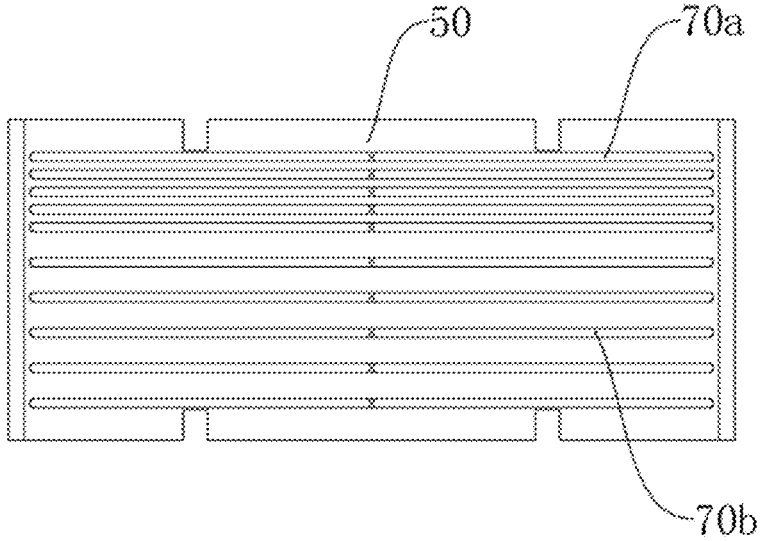
FIG. 6 is a schematic view of a side of a first substrate away from the light source assembly provided by an embodiment of the present application.
Figure 7:
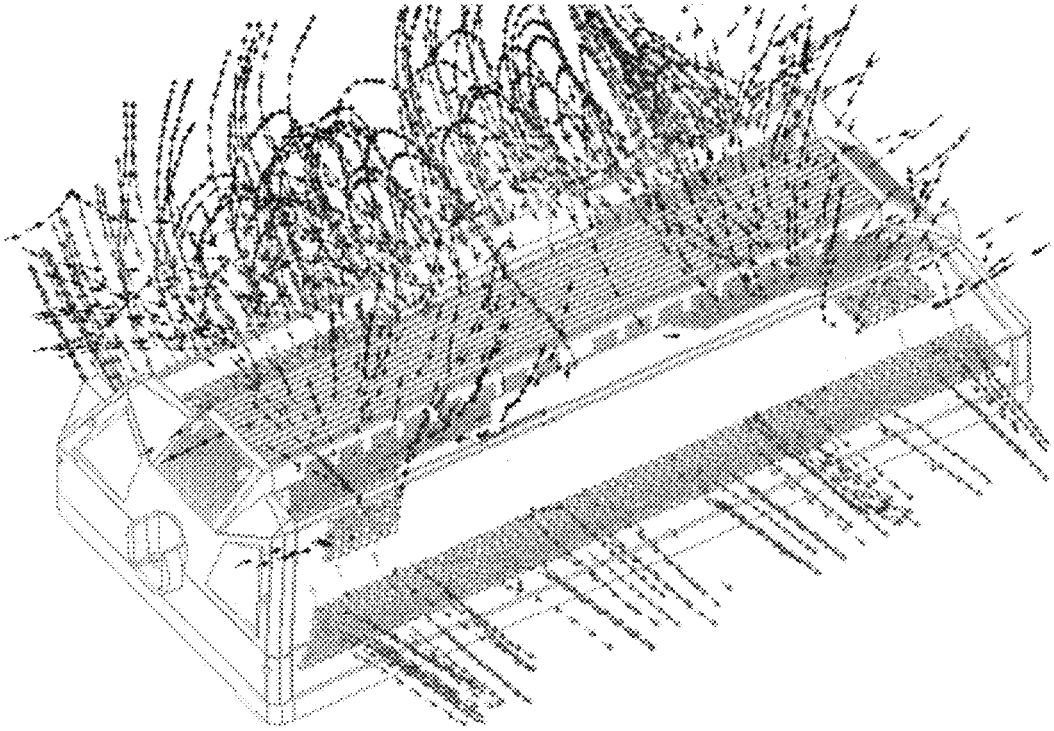
FIG. 7 is an airflow trajectory pattern of an illumination apparatus provided by an embodiment of the present application.

As shown in FIG. 4 and FIG. 6, in this embodiment, at least two electrical assemblies comprise first electrical modules 20*a* and second electrical modules 20*b*. The power of each of the first electrical modules 20*a* is greater than the power of each of the second electrical modules 20*b*. The plurality of heat tubes 70 comprise a first heat tube group 70*a* and a second heat tube group 70*b*. The first heat tube group 70*a* comprises a plurality of heat tubes 70, and the second heat tube group 70*b* also comprises a plurality of heat tubes 70. A sum of the number of the heat tubes in the first heat tube group 70*a* and the number of the heat tubes in the second heat tube group 70 are a sum of the number of the heat tubes 70 as shown in FIG. 3.

In the direction of the second connection line, the plurality of heat tubes in the first heat tube group 70*a* are sequentially arranged in parallel and at intervals, and the plurality of heat tubes in the second heat tube group 70*b* are sequentially arranged in parallel and at intervals. In addition, the arrangement density of the first heat tube group 70*a* is greater than the arrangement density of the second heat tube group 70*b*.

In the direction of the first connection line, the first electrical modules 20*a* and the first heat tube group 70*a* are arranged in alignment to each other, and the second electrical modules 20*b* and the second heat tube group 70*b* are arranged in alignment to each other. It can be understood that the heat generated by the first electrical modules 20*a* is greater than the heat generated by the second electrical modules 20*b*, and the above configuration can achieve the purpose of uniform distribution of the heat and facilitate the heat loss.

In an embodiment, the plurality of heat tubes 70 are embedded on the side of the first substrate 50 away from the light source assembly 10. It can be understood that in other embodiments, the heat tubes 70 can also be arranged on the side of the second substrate 60 away from the circuit board 20.

In an embodiment, each of the heat tubes 70 comprises at least two segmental heat tubes. The at least two segmental heat tubes are sequentially connected along the arrangement direction of the fins, and the axes of the at least two segmental heat tubes coincide. The segmentation arrangement of the heat tubes can effectively prevent the integral heat tube 70 from being too long, which would otherwise affect the heat transfer capacity thereof. Since an axial equivalent thermal conductivity of the heat tube 70 is very high, the heat of the first substrate 50 and the fin assembly 30 can be quickly and evenly conducted and diffused. Such an arrangement does not affect the installation of the light source assembly 10, and can realize the purpose of efficient heat conduction and uniform temperature as well.

Figure 2:
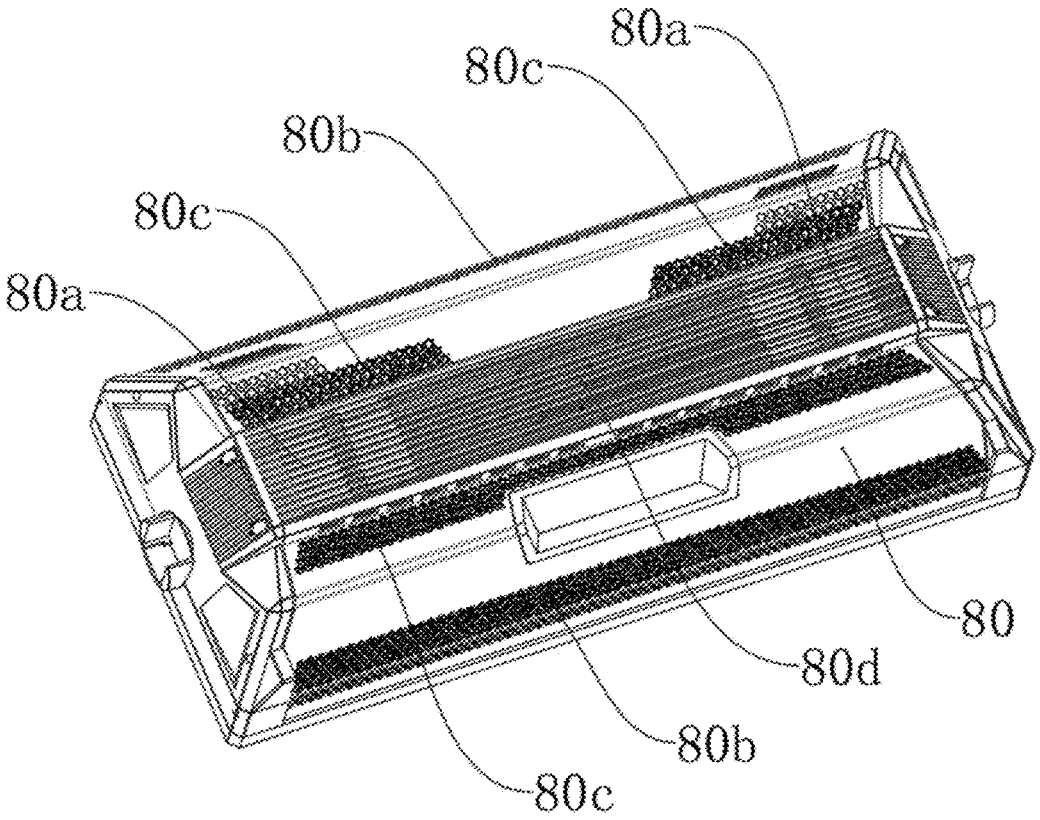
FIG. 2 is an assembled schematic view of an illumination apparatus provided by an embodiment of the present application, where a center region of the casing configured for fixed connection with a power source is indicated.

As shown in FIGS. 1-2, 5, and 7, in an embodiment, the illumination apparatus further comprises a casing 80. The casing 80 defines therein first air inlets 80*a* and air outlets 80*b* passing through a casing wall. The first air inlets 80*a* are arranged perpendicular to a plane formed by the first connection line and the second connection line. For example, the first air inlets 80 can be understood as being arranged along the arrangement direction of the fin assembly 30, or the length direction of the illumination apparatus as shown in the figures. The first air inlets 80*a* communicate with gaps among blades of the fan 40. As shown in FIGS. 1-3, the first air inlets 80*a* can adopt two opening directions. A first opening direction can be configured away from the light-emitting surface and along the first connecting direction, and the second opening direction is perpendicular to the first opening direction. It can be understood that the first air inlets 80*a* comprise arrays of strip holes located at two sides the power source 90 along the length of the casing 80. The first air inlets 80*a* further comprise multiple rectangular air inlets located at another two sides of the power source 90 along the width direction of the casing 80. The multiple rectangular air inlets are arranged along the length direction of the power source 90. The air outlets 80*b* communicate with the first thermal dissipation ends 30*c* and the second thermal dissipation ends 30*d*. The connection path between the first air inlets 80*a* and the gaps among the blades linearly extends along the direction of the first connection line. Both the connection path between the air outlets 80*b* and the first thermal dissipation ends 30*c* and the connection path between the air outlets 80*b* and the second thermal dissipation ends 30*d* extend along the direction of the second connecting line.

In the existing technology, high-power LED light source apparatus often involves complicated and large number of control circuits and power adapters. These numerous components can easily lead to complex flow channel structures of the apparatus, tortuous heat dissipation paths, which would result in large frictional resistances, the flow resistance may change greatly, and the local pressure loss is great.

In contrast, in the illumination apparatus provided by the embodiments of the present application, the first air inlets 80*a* and the gaps among the blades of the fan 40 are linearly connected along the direction of the first connection line, and the airflow linearly passes through the circuit board 20 and the second substrate 60. The airflow entering from the first air inlet 80*a* reaches the fan 40 along a straight line, after passing through the gaps among the adjacent blades of the fan 40, the airflow turns into the connection path between the air outlets 80*b* and the first thermal dissipation ends 30*c*, as well as the connection path between the air outlets 80*b* and the second thermal dissipation ends 30*d*, and the airflow linearly passes through the fin gaps along the direction of the second connection line.

That is, the air inlet path is configured in a straight line, and the air outlet path is also configured in a straight line, and the whole path of the airflow only has one turning. By such configuration, the flow path of the airflow can be shortened, the flow channel is the simplest, and the integration of the apparatus is maximized. The smaller the resistance loss of the flow channel, the lower the noise generated during the operation of the apparatus, and the maximum utilization of the power of the fan 40 can be achieved.

In an embodiment, the illumination apparatus further comprises a power source 90. The power source 90 is connected within the casing 80, for example, the power source 90 can be fixed to an inside of the casing 80 by fasteners such as screws. Herein, the inside of the casing 80 can be understood as an inner cavity of the casing 80 of the illumination apparatus. The power source 90 is in electrical connection with one or more of the light source assembly 10, the circuit board 20, and the fan 40. It can be understood that the power source 90 can be a power adapter, and the power adapter can be, for example, an AC to DC power supply conversion apparatus. An output end of the power adapter can be connected to the circuit board 20, the fan 40, the light source assembly 10, etc., it can be understood that the light source assembly 10 and the fan 40 can also be electrically connected to the circuit board 20, and the circuit board 20 can be connected to the power adapter. It can be understood that the specific electrical connection can be adapted according to actual needs, which is not specifically limited here. The power source 90 is arranged in the connection path between the first air inlets 80*a* and the gaps among the blades; or alternatively, the power source 90 is arranged in the connection path between the air outlets 80*b* and the first thermal dissipation ends 30*c* or the connection path between the air outlets 80*b* and the second thermal dissipation ends 30*d*. In this way, the power source 90 is beneficially arranged in the air inlet path or the air outlet path, and the light source assembly 10, the circuit board 20, and the power source 90 in the illumination apparatus can be highly integrated with efficient heat dissipation.

In an embodiment, the power source 90 is fixedly connected to at least one of the casing 80, the fin assembly 30, and the fan 40. The at least one of the casing 80, the fin assembly 30, and the fan 40 is used as the support basis for the power source 90. For example, the power source 90 is supported in the connection path between the first air inlets 80*a* and the gaps among the blades; or, the power source 90 is supported in the connection path between the air outlets 80*b* and the first thermal dissipation ends 30*c*; or the power source 90 is supported in the connection path between the air outlets 80*b* and the second thermal dissipation ends 30*d*.

As shown in FIG. 2, in an embodiment of the present application, the position of the power source 90 is determined by adopting the casing 80 as a support base of the power source 90. In an embodiment, the power source 90 is in fixed connection with an inner side of the casing 80, and the power source 90 is arranged adjacent to inner sides of the first air inlets 80*a*. The power source 90 is close to the inner sides of the first air inlets 80*a*, and the inner sides of the first air inlets 80*a* are a part of the conduction path between the first air inlets 80*a* and the fan 40, so that the heat generated by the power source 90 can be efficiently carried away.

In this embodiment, a part of the casing 80 is convex away from the circuit board 20 (which does not necessarily mean that the casing is an integrally formed structure). Thus, a space is formed between the circuit board 20 and the convex portion. The first air inlets 80*a* are defined in the convex portion, and the power source 90 is arranged within in the space. In this embodiment, the casing 8 is formed by splicing a plurality of splicing casing portions in concave-convex structures.

Specifically, at the convex portion, the power source 90 is in fixed connection at the inner side of a center region of the casing (the same shaded area as indicated by 80*d* in FIG. 2) along the length direction of the illumination apparatus. The first air inlets 80*a* are respectively arranged at two sides of the center region of the casing (the same shaded area as indicated by 80*d* in FIG. 2).

In this embodiment, each first air inlet 80*a* is provided with a grid structure to prevent large particles of impurities from entering the casing 80 due to the drawing of the fan 40. Alternatively, a grid structure may also be arranged along the length direction of the illumination apparatus at an outer side of the first air inlet 80*a*, in such condition, the arrangement of the grid structure at the outer side of the first air inlet 80*a* may also achieve the same purpose.

It can be understood that, furthermore, since the convex portion has lateral sides which are formed during the stretching of the convex portion, the first air inlets 80*a* are further defined in the lateral sides, as shown in FIGS. 3-4, in which, the first air inlets 80*a* are defined in the lateral sides of the convex portion.

It can be understood that, in other embodiments, the power source 90 can be arranged between the fin assembly 30 and the air outlets 80*b*. For example, as long as the width of the illumination apparatus permitted, the power source 90 can be installed within the space between the first thermal dissipation ends 30*c* and the air outlets 80*b*, or the power source 90 can be installed within the space between the second thermal dissipation ends 30*d* and the air outlets 80*b*. For example, an escape space is defined in the fin assembly 30 facing the air outlets 80*b*, and the power source 90 is accommodated in the escape space.

In an embodiment, the casing 80 further defines therein second air inlets 80*c* passing through the casing wall. The second air inlets are arranged adjacent to the first air inlets 80*a*. The second air inlets and the circuit board 20 are arranged oppositely to each other in the direction of the first connection line and a negative pressure zone 80*c* is formed between the second air inlets and the circuit board 20. The fan 40 is configured to draw air through the first air inlets 80*a* and evacuate the airflow in the negative pressure zone 80*c*, so that a negative pressure is formed in the negative pressure zone 80*c* and airflow outside the casing 80 is drawn through the second air inlets 80*a*. It can be understood that the second air inlets 80*c* may be arranged at the casing at two sides of the power source (adapter).

In the space between the first air inlets 80*a* and the fan 40, the airflow is drawn by the fan 40 to form suction airflow. The airflow in the space between the second air inlets and the circuit board 20 is continuously evacuated, and a negative pressure is generated above the circuit board 20, such that the airflow outside the casing 80 can be continuously drawn to the negative pressure space via the second air inlets. The airflow enters the casing 80 under the action of negative pressure and passes through the circuit board 20, which further solves the heat dissipation problem of the electrical components on the circuit board 20.

In this embodiment, gaps are formed among the blades of the fan 40 and are configured to draw the air from the outside of the fan 40 into the inside of the fan 40 and to introduce the airflow inside the fan 40 out. In the embodiment of the present application, each fan has a central axis and a plurality of blades connected to the central axis. A plurality of blades are arranged in a spiral manner along an outer circumference of the central axis. The gap is formed between adjacent blades, and the gaps formed among the plurality of blades constitute an airflow guide channel configured for sucking and discharging the air. In this embodiment, bases on the blades are connected to the central axis, and tips of the blades extend and inclined towards directions away from the first air inlets 80*a*. In this way, the air drawn by the fan from the first air inlets 80*a* impinges on the heat dissipation fins in a manner of downward pressure blowing, and flows out along the air outlet paths between adjacent fins.

In an embodiment, along the direction of the first connection, at least part of the fan 40 overlaps with at least part of the fin assembly 30, so as to reduce the size of the whole apparatus along the direction of the first connection line, that is, the thickness dimension as shown in FIG. 1.

In an embodiment, the fin assembly 30 defines therein a first accommodation cavity 30*e*. The first accommodation cavity 30*e* is concaved in the direction of the first connection line, for example, forming a sinking concave shape. The first accommodation cavity 30*e* is arranged between the first thermal dissipation ends 30*c* and the second thermal dissipation ends 30*d*, and the fan 40 is located in the first accommodation cavity 30*e*. The fan 40 and the fin assembly 30 at least partially overlap with each along the direction of the first connection line. It can be understood that the fan can be completely located in the first accommodation cavity 30*e* and flush with the second substrate 60, so that the size of the fan 40 in the direction of the first connection line can completely overlap with the size of the fin assembly 30 in the direction of the first connection line, in which way, the overall size of the apparatus in the direction of the first connection line can be minimized to the greatest extend.

In an embodiment, first notches 50*a* are defined at edges of the first substrate 50, second notches 60*a* are defined at edges of the second substrate 60, third notches are defined at the first thermal dissipation ends 30*c* or the second thermal dissipation ends 30*d*, and the first notches 50*a*, the second notches 60*a*, and the third notches 30*f* communicate along the direction of the first connection line. It can be understood that these notches may be completely aligned and flush with each other. It can also be understood that these notches may not be completely aligned with each other, but still form a complete communication channel, as long as wires can be placed therein. The illumination apparatus further comprises an electrical connector (not shown in the figures). The circuit board 20 and the light source assembly 10 are electrically connected through the electrical connector. The electrical connector is arranged within the space communicating the first notches 50*a*, the second notches 60*a*, and the third notches 30*f* Generally, the electrical connector may comprise: a first electrical connection adapter adapted to the light source assembly, a second electrical connection adapter adapted to the circuit board, and several wires in connection between the first electrical connection adapter and the second electrical connection adapter.

In the illumination apparatus provided by the above embodiment, different ends of the fins in the fin assembly 30 are configured to realize different functions. Different ends of the fins are fully utilized to provide heat conduction paths for the light source assembly 10 and the circuit board 20. Moreover, the power source 90 is configured in the air inlet path or the air outlet path, and corresponding heat conduction paths are particularly configured for the components requiring heat dissipation in the apparatus, such that the components requiring heat dissipation are provided with separate heat conduction paths. Since the components requiring heat dissipation in the apparatus are different in the heating powers as well as the heat quantity required to be dissipated per unit time, each component requiring heat dissipation has an independent heat conduction path. Each path can be correspondingly constructed according to the heating power of the corresponding components requiring heat dissipation. Each path can be fully utilized. The heat dissipation path has no margin, the heat dissipation area has no waste, the structure of the whole apparatus can be simplified, the lightweight can be realized, and the heat dissipation efficiency is synchronously improved, such that the series problems caused by the integration of the components requiring heat dissipation in the light source in the existing technology are avoided.

The aforementioned embodiments are only preferred embodiments of the present application, and are not intended to limit the present application. Any modification, equivalent replacement, improvement, and so on, which are made within the spirit and the principle of the present application, should be included in the protection scope of the present application.

What is claimed is:

1. An illumination apparatus, comprising:

a light source assembly, a circuit board, a fin assembly, a casing, and a fan;

wherein the light source assembly is in electrical connection with the circuit board;

the fan is configured to generate a flowing airflow;

the fin assembly comprises a plurality of fins arranged at intervals in a configured direction;

the plurality of fins each has a first thermal connection end and a second thermal connection end arranged oppositely to each other, as well as a first thermal dissipation end and a second thermal dissipation end arranged oppositely to each other;

a connection line connecting the first thermal connection end and the second thermal connection end is defined as a first connection line;

a connection line connecting the first thermal dissipation end and the second thermal dissipation end is defined as a second connection line;

the first connection line and the second connection line forms an angle;

the light source assembly is in thermal connection with the first thermal connection end, and the circuit board is in thermal connection with the second thermal connection end;

the airflow generated by the fan is enabled to pass through the fins and flow out from the first thermal dissipation end and the second thermal dissipation end to drive a heat of the first thermal connection end and the second thermal connection end out of the fin assembly;

the casing defines therein first air inlets and air outlets passing through a casing wall;

the first air inlets are arranged perpendicular to a plane formed by the first connection line and the second connection line;

the first air inlets communicate with gaps among blades of the fan;

the air outlets communicate with the first thermal dissipation ends and the second thermal dissipation ends;

the connection path between the first air inlets and the gaps among the blades linearly extends along the direction of the first connection line; and both the connection path between the air outlets and the first thermal dissipation ends and the connection path between the air outlets and the second thermal dissipation ends extend along the direction of the second connecting line.

2. The illumination apparatus of claim 1, further comprising:

a first substrate, wherein a side of the first substrate facing the light source assembly is in thermal connection with the light source assembly, and a side of the first substrate away from the light source assembly is in thermal connection with the first thermal connection end; and/or a second substrate, wherein and a side of the second substrate facing the circuit board is in thermal connection with the circuit board, and a side of the second substrate far away from the circuit board is in thermal connection with the second thermal connection end.

3. The illumination apparatus of claim 2, wherein the circuit board has at least two electrical assemblies having different powers; the at least two electrical assemblies are sequentially arranged along a direction of the second connection line; and the illumination apparatus further comprises a plurality of heat tubes; the plurality of heat tubes are in thermal connection between the first thermal connection end and the first substrate; the plurality of heat tubes are arranged at intervals along a direction of the second connection line; and an arrangement density of the plurality of heat tubes is positively related to a power of the electrical module assembly.

4. The illumination apparatus of claim 2, wherein the illumination apparatus comprises the first substrate and the second substrate;

first notches are defined at edges of the first substrate, second notches are defined at edges of the second substrate, third notches are defined at the first thermal dissipation ends and/or the second thermal dissipation ends, and the first notches, the second notches, and the third notches communicate along the direction of the first connection line; and the illumination apparatus further comprises an electrical connector; the circuit board and the light source assembly are electrically connected through the electrical connector; the electrical connector is arranged within the space communicating the first notches, the second notches, and the third notches.

5. The illumination apparatus of claim 2, wherein the light source assembly comprises a plurality of light plate;

the plurality of the light plates are in thermal connection with the first substrate; and the plurality of the light plates are arranged along the arrangement direction of the fins.

6. The illumination apparatus of claim 5, further comprising a plurality of fans; wherein the plurality of fans are arranged along the arrangement direction of the light plates, and each of the fans corresponds to one of the light plates in the direction of the first connection line; and the airflow generated by the fans is enabled to drive a heat of the second thermal connection end from the second thermal connection end to the first thermal connection end, and to drive both a heat of the first thermal connection end and the heat of the second thermal connection end to be synchronously discharged out of the fin assembly from the first thermal connection end.

7. The illumination apparatus of claim 1, wherein the circuit board has at least two electrical assemblies having different powers; the at least two electrical assemblies are sequentially arranged along a direction of the second connection line; and the illumination apparatus further comprises a plurality of heat tubes; the plurality of heat tubes are in thermal connection between the first thermal connection end and a first substrate; the plurality of heat tubes are arranged at intervals along a direction of the second connection line; and an arrangement density of the plurality of heat tubes is positively related to a power of the electrical module assembly.

8. The illumination apparatus of claim 1, further comprising a power source; wherein the power source is connected within the casing; the power source is in electrical connection with one or more of the light source assembly, the circuit board, and the fan; and the power source is arranged in the connection path between the first air inlets and the gaps among the blades; or alternatively, the power source is arranged in the connection path between the air outlets and the first thermal dissipation ends or the connection path between the air outlets and the second thermal dissipation ends.

9. The illumination apparatus of claim 1, wherein the casing further defines therein second air inlets passing through the casing wall;

the second air inlets are arranged adjacent to the first air inlets; the second air inlets are arranged perpendicular to the plane formed by the first connection line and the second connection line;

the second air inlets and the circuit board are arranged oppositely to each other in the direction of the first connection line and a negative pressure zone is formed between the second air inlets and the circuit board; and the fan is configured to draw air through the first air inlets and evacuate the airflow in the negative pressure zone, so that a negative pressure is formed in the negative pressure zone and the airflow outside the casing is drawn through the second air inlets.

10. The illumination apparatus of claim 1, wherein the fin assembly defines therein a first accommodation cavity;

the first accommodation cavity is concaved in the direction of the first connection line;

the first accommodation cavity is arranged between the first thermal dissipation ends and the second thermal dissipation ends;

the fan is located in the first accommodation cavity; and the fan and the fin assembly at least partially overlap with each along the direction of the first connection line.

11. The illumination apparatus of claim 1, further comprising a first substrate and a second substrate;

wherein a side of the first substrate facing the light source assembly is in thermal connection with the light source assembly, and a side of the first substrate away from the light source assembly is in thermal connection with the first thermal connection end;

a side of the second substrate facing the circuit board is in thermal connection with the circuit board; and a side of the second substrate far away from the circuit board is in thermal connection with the second thermal connection end;

first notches are defined at edges of the first substrate, second notches are defined at edges of the second substrate, third notches are defined at the first thermal dissipation ends and/or the second thermal dissipation ends, and the first notches, the second notches, and the third notches communicate along the direction of the first connection line; and the illumination apparatus further comprises an electrical connector; the circuit board and the light source assembly are electrically connected through the electrical connector; the electrical connector is arranged within the space communicating the first notches, the second notches, and the third notches.

12. An illumination apparatus, comprising: a light source assembly, a circuit board, a fin assembly, a first substrate, a second substrate, and a fan;

wherein the light source assembly is in electrical connection with the circuit board;

the fan is configured to generate a flowing airflow;

the fin assembly comprises a plurality of fins arranged at intervals in a configured direction;

the plurality of fins each has a first thermal connection end and a second thermal connection end arranged oppositely to each other, as well as a first thermal dissipation end and a second thermal dissipation end arranged oppositely to each other;

a connection line connecting the first thermal connection end and the second thermal connection end is defined as a first connection line;

a connection line connecting the first thermal dissipation end and the second thermal dissipation end is defined as a second connection line;

the first connection line and the second connection line forms an angle;

the light source assembly is in thermal connection with the first thermal connection end, and the circuit board is in thermal connection with the second thermal connection end;

the airflow generated by the fan is enabled to pass through the fins and flow out from the first thermal dissipation end and the second thermal dissipation end to drive a heat of the first thermal connection end and the second thermal connection end out of the fin assembly;

a side of the first substrate facing the light source assembly is in thermal connection with the light source assembly, and a side of the first substrate away from the light source assembly is in thermal connection with the first thermal connection end;

a side of the second substrate facing the circuit board is in thermal connection with the circuit board; and a side of the second substrate far away from the circuit board is in thermal connection with the second thermal connection end;

first notches are defined at edges of the first substrate, second notches are defined at edges of the second substrate, third notches are defined at the first thermal dissipation ends and/or the second thermal dissipation ends, and the first notches, the second notches, and the third notches communicate along the direction of the first connection line; and the illumination apparatus further comprises an electrical connector; the circuit board and the light source assembly are electrically connected through the electrical connector; the electrical connector is arranged within the space communicating the first notches, the second notches, and the third notches.

13. The illumination apparatus of claim 12, further comprising:

a first substrate, wherein a side of the first substrate facing the light source assembly is in thermal connection with the light source assembly, and a side of the first substrate away from the light source assembly is in thermal connection with the first thermal connection end; and/or a second substrate, wherein and a side of the second substrate facing the circuit board is in thermal connection with the circuit board, and a side of the second substrate far away from the circuit board is in thermal connection with the second thermal connection end.

14. The illumination apparatus of claim 13, wherein the circuit board has at least two electrical assemblies having different powers; the at least two electrical assemblies are sequentially arranged along a direction of the second connection line; and the illumination apparatus further comprises a plurality of heat tubes; the plurality of heat tubes are in thermal connection between the first thermal connection end and the first substrate; the plurality of heat tubes are arranged at intervals along a direction of the second connection line; and an arrangement density of the plurality of heat tubes is positively related to a power of the electrical module assembly.

15. The illumination apparatus of claim 13, wherein the illumination apparatus comprises the first substrate and the second substrate;

first notches are defined at edges of the first substrate, second notches are defined at edges of the second substrate, third notches are defined at the first thermal dissipation ends and/or the second thermal dissipation ends, and the first notches, the second notches, and the third notches communicate along the direction of the first connection line; and the illumination apparatus further comprises an electrical connector; the circuit board and the light source assembly are electrically connected through the electrical connector; the electrical connector is arranged within the space communicating the first notches, the second notches, and the third notches.

16. The illumination apparatus of claim 13, wherein the light source assembly comprises a plurality of light plate;

the plurality of the light plates are in thermal connection with the first substrate; and the plurality of the light plates are arranged along the arrangement direction of the fins.

17. The illumination apparatus of claim 16, further comprising a plurality of fans; wherein the plurality of fans are arranged along the arrangement direction of the light plates, and each of the fans corresponds to one of the light plates in the direction of the first connection line; and the airflow generated by the fans is enabled to drive a heat of the second thermal connection end from the second thermal connection end to the first thermal connection end, and to drive both a heat of the first thermal connection end and the heat of the second thermal connection end to be synchronously discharged out of the fin assembly from the first thermal connection end.

18. The illumination apparatus of claim 12, wherein the circuit board has at least two electrical assemblies having different powers; the at least two electrical assemblies are sequentially arranged along a direction of the second connection line; and the illumination apparatus further comprises a plurality of heat tubes; the plurality of heat tubes are in thermal connection between the first thermal connection end and a first substrate; the plurality of heat tubes are arranged at intervals along a direction of the second connection line; and an arrangement density of the plurality of heat tubes is positively related to a power of the electrical module assembly.

19. The illumination apparatus of claim 12, wherein the fin assembly defines therein a first accommodation cavity;

the first accommodation cavity is concaved in the direction of the first connection line;

the first accommodation cavity is arranged between the first thermal dissipation ends and the second thermal dissipation ends;

the fan is located in the first accommodation cavity; and the fan and the fin assembly at least partially overlap with each along the direction of the first connection line.

* * * * *